US006560427B2

(12) United States Patent
Kubo et al.

(10) Patent No.: US 6,560,427 B2
(45) Date of Patent: May 6, 2003

(54) ELECTROPHOTOGRAPHIC IMAGE FORMING APPARATUS

(75) Inventors: Norihiko Kubo, Ibaraki (JP); Yuji Nakayama, Chiba (JP); Hisataka Hisakuni, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/941,778

(22) Filed: Aug. 30, 2001

(65) Prior Publication Data

US 2002/0028100 A1 Mar. 7, 2002

(30) Foreign Application Priority Data

Sep. 1, 2000 (JP) ..... 2000-266087

(51) Int. Cl.[7] ..... G03G 15/00; G03G 15/01; G03G 21/00

(52) U.S. Cl. ..... 399/159; 399/299; 399/303; 399/350

(58) Field of Search ..... 399/159, 350, 399/297, 298, 299, 303

(56) References Cited

U.S. PATENT DOCUMENTS 5,604,574 A * 2/1997 Matsuura et al. ..... 399/350

6,381,437 B1 * 4/2002 Ozawa et al. ..... 399/350

FOREIGN PATENT DOCUMENTS

| | | |
|---|---|---|
| JP | 4-335387 | 11/1992 |
| JP | 6-130711 | * 5/1994 |
| JP | 11-218953 | 8/1999 |

* cited by examiner

*Primary Examiner*—William J. Royer
(74) *Attorney, Agent, or Firm*—Fitzpatrick, Cella, Harper & Scinto

(57) ABSTRACT

An image forming apparatus has a first image bearing body for bearing an image formed by a substantially spherical toner, transferring belt for transferring a toner image formed on the first image bearing body onto a second image bearing body, and a cleaning member, abutting on the first image forming body, for sweeping away the toner remaining on the first image bearing body after a transferring operation by the transferring belt, wherein the first image bearing body contains a fluororesin on its surface, a content ratio F (% by weight) of the fluororesin is in a range of $10 \leqq F \leqq 50$, a surface roughness Rz ($\mu$m) of the first image bearing body is $Rz<5.0$, and a dynamic friction coefficient $\mu$ between the first image bearing body and the cleaning member is in a range of $0.5 \leqq \mu \leqq 2.5$.

14 Claims, 5 Drawing Sheets

FIG. 5

| LINE PRESSURE A OF BLADE | $200 \times 10^{-3}$ | $250 \times 10^{-3}$ | $300 \times 10^{-3}$ | $400 \times 10^{-3}$ | $500 \times 10^{-3}$ | $550 \times 10^{-3}$ | $600 \times 10^{-3}$ |
|---|---|---|---|---|---|---|---|
| EVALUATION OF EDGE | PASSAGE OF TONER | GOOD | GOOD | GOOD | GOOD | GOOD | CHATTERING (ABNORMAL VIBRATION) |

FIG. 6

| FOR EMBODIMENTS | SHAPE OF TONER | INITIAL GRINDING Rz ( $\mu$m) | TEFLON™ AMOUNT ON PHOTO-SENSITIVE BODY (%) | COEFFICIENT OF DYNAMIC FRICTION BETWEEN PHOTO-SENSITIVE BODY SURFACE AND BLADE $\mu$ | IMAGE EVALUATION AFTER 20 THOUSANDS COPIES |
|---|---|---|---|---|---|
| EMBODIMENT 1 | SPHERICAL | 1.5 | 30% | 0.48 | GOOD |
| EMBODIMENT 2 | SPHERICAL | 1.5 | 20% | 0.63 | GOOD |
| EMBODIMENT 3 | SPHERICAL | 3 | 10% | 1.28 | GOOD |
| COMPARISON EXAMPLE 1 | SPHERICAL | 3 | 0% | 3.11 | CHIP OF BLADE |
| EMBODIMENT 4 | SPHERICAL | 0.2 | 30% | 2.53 | GOOD |
| COMPARISON EXAMPLE 2 | SPHERICAL | 0.2 | 20% | 2.88 | CHIP OF BLADE |
| COMPARISON EXAMPLE 3 | SPHERICAL | 3 | 30% | 0.34 | PASSAGE OF TONER |
| EMBODIMENT 5 | SPHERICAL | 4 | 10% | 1.18 | GOOD |
| COMPARISON EXAMPLE 4 | SPHERICAL | 5 | 10% | 0.98 | PASSAGE OF TONER |
| EMBODIMENT 6 | SPHERICAL | 0.1 | 40% | 0.65 | GOOD |
| COMPARISON EXAMPLE 5 | SPHERICAL | 0.1 | 50% | 0.38 | PASSAGE OF TONER |

ELECTROPHOTOGRAPHIC IMAGE FORMING APPARATUS

BACKGROUND OF THE INVENTION

1. Field of the Invention

The present invention relates to an image forming apparatus for a copying machine, a printer, a facsimile or the like.

2. Related Background Art

Recently, an electrophotographic system composite machine equipped with all of output terminals such as a copying machine, a printer and a facsimile is extensively spreading as an output terminal compatible with a network. As one of serious problems of such an electrophotographic system composite machine, a duty cycle of an apparatus body is taken up. This duty cycle can be defined as the limited number of formed images during which the apparatus body can be normally operated without the maintenance of a serviceperson, and this limited number depends largely on a life of a photosensitive drum.

Furthermore, from the viewpoint of ecology, it is a serious theme to eliminate wastes, that is, to reduce expendables, to extend the lives of the expendables, and to improve the reliability of the expendables.

Additionally, in the apparatus body, digitalization makes progress from a conventional analog device, and it is also an additional theme to make the cost of a digitalized apparatus body equal to or less than that of the analog device.

Moreover, as for the copying machines and the printers, black-and-white machines have heretofore mainly been used, but full-color machines are rapidly increasing in offices and the like. In addition to the machine bodies themselves, it is also requested that the running cost of the full-color machines is substantially equal to that of the black-and-white copying machines. To attain this object, a technology capable of drastically reducing Total Cost Ownership (TCO) is desired.

Under such circumstances, in recent years, there has extensively spread a color image forming apparatus (e.g., a four-throw tandem type color image forming apparatus) comprising a plurality of electronically photosensitive bodies (photosensitive bodies) as image bearing bodies and a transferring belt (a recording material bearing body) for bearing and transferring a recording material. In this kind of color image forming apparatus, transferable toner images of different colors formed on the respective photosensitive bodies (hereinafter referred to simply as "the toner image") are transferred in turn onto the recording material borne on the transferring belt to obtain a color image.

In the image forming apparatus in which there is repeated a process of transferring the toner image formed on the surface of the photosensitive body onto the recording material (mainly a paper), it is essential every process to sufficiently remove the toner (the residual toner) remaining on the surface of the photosensitive body which has not been transferred onto the recording material in a transfer step.

Therefore, as cleaning means, a number of suggestions have heretofore been made, but the cleaning means for scraping away the remaining toner by a cleaning blade comprising an elastic material such as a urethane rubber is of a simple and compact constitution and is low in cost. Besides, such cleaning means has an advantage of an excellent toner removing function and the like, and is therefore put to practical use extensively. As a rubber material of the cleaning blade, there is generally used a urethane rubber having a high hardness and rich elasticity, excellent friction resistance, mechanical strength, oil resistance, and ozone resistance.

In the aforesaid image forming apparatus, however, the following first to fourth problems have occurred.

As the first problem, a frictional force between the photosensitive body and a residual material thereon caused by the cleaning blade is inconveniently increased with time. This fact has been confirmed by an experiment. Owing to a filming film formed with time, adhesion and affinity between the cleaning blade and the surface of the photosensitive body and between the residue and the surface of the photosensitive body increase, so that frictional force increases. In addition, it has been found that the frictional force depends with time on the shape of the photosensitive body surface formed by initial grinding.

An increase in the frictional force is considered to be due to an increase in shearing stress of the cleaning blade, shearing stress between the toners and shearing stress in the vicinity of the photosensitive body surface. As a result, the increase in the frictional force is considered to lead to the occurrence of chipping (localized chipping of an edge) of the cleaning blade, the fusion of the toner due to heat generated by an increase in permanent strain shearing force, and the occurrence of fatigue wear due to an increase in internal stress of the photosensitive body. Incidentally, the excessive reduction in the frictional force reduces the adhesion between an edge section of the cleaning blade and the surface of the photosensitive body, so that a frictional effect intrinsic in the blade on the surface of the photosensitive body is lost. That is, when a continuous image formation is performed in a system in which the frictional force is excessively low, the filming film is easily formed, so that there is a possibility that the frictional force conversely increases, as described above.

As the second problem, the composite machine is used not only as the copying machine but also as the printer in recent years as described above, so that the number of formed images in one operation is increased and hence the residual material easily adheres to the surface of the photosensitive body. Applications for a feeder function and a sorter function are also fulfilled, so that as one job (the number of the formed images), a continuous operation of 4000 sheets or more has become possible. For example, in the case of an A4 size machine of 50 sheets/minute, a continuous image forming operation for 80 minutes or more is to be performed as understood by simple calculation. Under such circumstances, it is considered that ambient temperature in the vicinity of the transferring belt reaches about 50° C., and an abutting portion (a nip portion) between the cleaning blade and the surface of the photosensitive body reaches a temperature more than the above temperature. As a result, the residual material is often stuck or coagulated on the surface of the photosensitive body.

Regarding the third problem, as the grain size of the toner becomes smaller, it is possible to perform developing with an excellent dot reproducibility and resolution, and sharpness and image quality of the toner image are improved, but in this case, too, since the specific surface area increases, sticking force per unit weight of the toner to the photosensitive body surface is increased, and the cleaning performance of the photosensitive body surface is deteriorated. As the grain size of the toner becomes smaller, since fluidity of the toner is deteriorated, greater amount of additive becomes necessary, and as a result, there arises a problem in which wear or chipping of the cleaning blade, a localized linear scratch, and the like occur on the photosensitive body surface as described above.

As the fourth problem, in recent years, a polymer toner is being diversified to improve transferring efficiency, eliminate and the like the coating of mould releasing agent on fixing means. However, a toner manufactured by the polymerization method generally has a high sphericity. When the sphericity is improved, and a counter blade system generally used in the past is adopted, passage of the toner increases if abutment pressure as usual is used, and it becomes necessary to increase the abutment pressure further. As a result, a localized shear force is applied to the cleaning blade, causing chipping of the edge.

In order to prevent nonconformities of the first through fourth problems as described above, a method has been used in the past in which a lubricant is coated in advance on the edge section of the cleaning blade to reduce the frictional force between the photosensitive body and the cleaning blade.

For example, when spherical grains are used as the lubricant, since the lubricating performance of the grain itself is extremely high, its effect as the lubricant is excellent, however, since the lubricant has a property to easily pass through the edge section of the cleaning blade, the lubricant fell from the edge section due to fine vibrations of said edge section, and thus the lubricating effect was lost. As a measure to cope with the situation, an attempt and the like to increase the coating amount of the spherical grains was made, but a problem resulted in which the peeling amount of the lubricant also increased corresponding to an increase in the coating amount of the spherical grains, and the peeled lubricant existed on the photosensitive body preventing the exposure, and caused a defect in the image.

In addition, if unshaped grains are to be used as the lubricant, passing of the lubricant through the edge section of the cleaning blade can be reduced, but the grains itself lack in lubricating capacity, and so-called chattering (abnormal vibration) is likely to occur between the photosensitive body surface and the cleaning blade during initial stage until a foreign matter, the toner and the like accumulates in the vicinity of the edge section and sufficient lubrication effect is obtained.

As described above, by working a device for a lubricant coating method, stable conditions of the cleaning blade can be obtained to a certain extent, but it was difficult to obtain a stabilized performance over a long period of time.

On the other hand, as another prior art aiming at stabilization of cleaning, Japanese Patent Application Laid-Open No. 4-335387 and Japanese Patent Application Laid-Open No. 11-218953 are disclosed.

In Japanese Patent Application Laid-Open No. 4-335387, a constitution is descried in which a fluorine compound or silicone compound is caused to be contained in a cleaning blade of a urethane rubber so as to maintain a dynamic friction coefficient between an image bearing body and the cleaning blade in a range of 0.2 to 1.2.

Further, in Japanese Patent Application Laid-Open No. 11-218953, a constitution is described in which fluororesin grains are caused to be contained in the outermost layer of a photosensitive body to improve the cleaning performance of a spherical toner and maintain the coefficient of friction between the photosensitive body surface and the urethane blade to be less than 1.0.

However, in either constitution of the above, since the available range of the coefficient of friction is about 1.0, it is difficult to adjust the coefficient of friction within this range, and a high cost and unstable cleaning performance are caused to occur easily.

SUMMARY OF THE INVENTION

The present invention has been developed in view of the above circumstances, and an object of the present invention is to provide an image forming apparatus in which the damage of a cleaning blade and the occurrence of defective cleaning can be prevented when a substantially spherical toner is swept away, to obtain a stable cleaning performance.

In order to achieve the aforesaid object, the present invention comprises an image forming apparatus comprising a first image bearing body for bearing an image formed with a substantially spherical toner, transferring means for transferring a toner image on said first image bearing body onto a second image bearing body, a cleaning member, abutting on said first image bearing body, for sweeping away the toner remaining on said first image bearing body after a transferring operation by said transferring means, wherein it is simultaneously satisfied that said first image bearing body contains a fluororesin on its surface, a content ratio F (% by weight) of said fluororesin is in a range of $10 \leqq F \leqq 50$, a surface roughness Rz ($\mu$m) of said first image bearing body is $Rz<5.0$, and a dynamic friction coefficient $\mu$ between said first image bearing body and said cleaning member is in a range of $0.5 \leqq \mu \leqq 2.5$.

These and other objects and advantages of the invention may be readily ascertained by referring to the following description and accompanying drawings.

BRIEF DESCRIPTION OF THE DRAWINGS

FIG. 5 a view showing the relation between the linear pressure of a cleaning blade and the evaluation of a blade edge section.

FIG. 6 is a diagram describing a surface roughness of a photosensitive body, the amount of TEFLON™ on the photosensitive body, a dynamic friction coefficient between a photosensitive body surface and an image evaluation after copying 20 thousands copies.

DETAILED DESCRIPTION OF THE EMBODIMENT

Embodiments of the present invention will be described hereinafter with reference to the drawings.

(First Embodiment)

Figure 1:
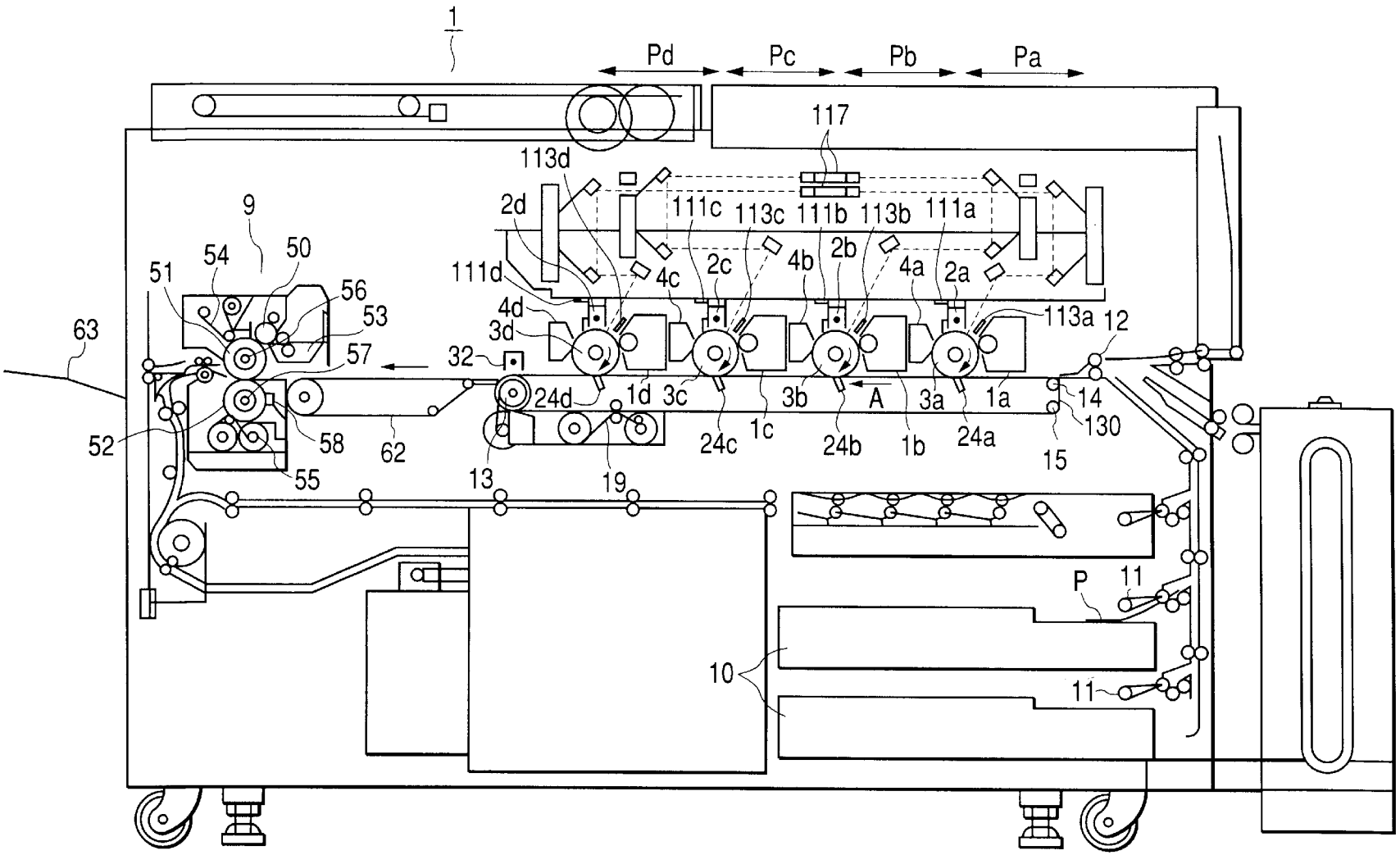
FIG. 1 is a longitudinal section showing a schematic constitution of an image forming apparatus according to the present invention.

FIG. 1 shows an example of an image forming apparatus according to the present invention. The image forming apparatus shown in FIG. 1 is an electrophotography type 4-full-color image forming apparatus, and FIG. 1 is a longitudinal section showing a schematic constitution thereof.

The image forming apparatus shown in FIG. 1 comprises four image forming stations (image forming sections) Pa, Pb, Pc and Pd having a process unit, an image bearing body, and the like in a main body 1 of the image forming apparatus. In the lower part of these image forming stations Pa, Pb, Pc and Pd is arranged an endless transferring belt (a recording material bearing body) 130 set on rollers 13, 14 and 15. The transferring belt 130 is driven to rotate in the direction of an arrow A by a driving motor (not shown). Below the transferring belt 130 are arranged feeding cassettes 10 in which recording materials P, paper and the like are stored. The recording material P is supplied in sequence by a feeding roller 11 from the recording material P of the highest position. The supplied recording material P is corrected of skew by a pair of registration rollers 12, synchronized with the image forming stations Pa, Pb, Pc and Pd and supplied to the transferring belt 130, borne on the surface of the transferring belt 130, and transferred in the same direction by the rotation of the transferring belt 130 in the direction of arrow A.

Next, a constitution of the aforesaid image forming stations Pa, Pb, Pc and Pd will be described. In each image forming stations Pa, Pb, Pc and Pd is provided photosensitive body drums 3*a*, 3*b*, 3*c* and 3*d* which are image bearing bodies, around the periphery of these photosensitive body drums 3*a*, 3*b*, 3*c* and 3*d* are respectively provided primary chargers 2*a*, 2*b*, 2*c* and 2*d*, developers 1*a*, 1*b*, 1*c* and 1*d*, transferring chargers 24*a*, 24*b*, 24*c* and 24*d*, cleaning units 4*a*, 4*b*, 4*c* and 4*d*, and front exposure devices 111*a*, 111*b*, 111*c* and 111*d*. Further, above the upper part of the aforesaid photosensitive body drums 3*a*, 3*b*, 3*c* and 3*d* is arranged an exposure unit 117 for forming an electrostatic latent image by irradiating a laser beam on the surface of the photosensitive body drums 3*a*, 3*b*, 3*c* and 3*d* after charging.

The aforesaid primary chargers 2*a*, 2*b*, 2*c* and 2*d* uniformly charge the photosensitive body drum surface with a specified polarity and an electric potential prior to exposing the photosensitive body drums 3*a*, 3*b*, 3*c* and 3*d*, and the developers 1*a*, 1*b*, 1*c* and 1*d* develop (visualize an image) by causing a toner of each color of black, magenta, yellow and cyan to be adhered to the electrostatic latent image exposed and formed on the photosensitive body drum surface. The transferring chargers 24*a*, 24*b*, 24*c* and 24*d* transfer the toner image formed on the photosensitive body drums 3*a*, 3*b*, 3*c* and 3*d* onto the recording material P, and remove the toner (residual toner) remaining on the photosensitive body drum surface, after transfer of the toner image, into the cleaning units 4*a*, 4*b*, 4*c* and 4*d* and the recording material P. The front exposure devices 111*a*, 111*b*, 111*c* and 111*d* remove the surface electric potential of the photosensitive body drums 3*a*, 3*b*, 3*c* and 3*d*, the exposure unit 117 comprises a semiconductor laser, a polygon mirror, an fθ lens and the like, receives an input of an electric digital image signal and exposes a laser beam modulated corresponding to such signal by irradiating the laser beam in the bus-line direction of the photosensitive body drums 3*a*, 3*b*, 3*c* and 3*d*.

On the slightly downstream side of the image forming station Pd along the rotating direction of the transferring belt 130 is arranged a separating charger 32, in a manner to oppose to the transferring belt 130, for separating the recording material P borne on the surface of the transferring belt 130 after transferring the toner. On the downstream side of the separating charger 32 is arranged a transferring belt 62 for transferring the recording material P after separation, and on the further downstream side are arranged a fixing unit 9 for fixing the toner image on the surface of the recording material P and a delivery tray 63 on which the fixed recording material P is loaded. The aforesaid fixing unit 9 comprises a fixing roller 51 having heating means, a heater and the like inside thereof, and a pressure roller 52 abutted thereon.

Further, below the lower part of the transferring belt 130 is arranged a belt cleaner 19 for removing an unnecessary toner and the like remaining on the surface of the transferring belt 130. Still further, in each image forming station Pa, Pb, Pc and Pd are arranged electric potential detecting sensors 113*a*, 113*b*, 113*c* and 113*d* for detecting the electric potential of the surface of the photosensitive body drums 3*a*, 3*b*, 3*c* and 3*d* after exposure.

Next, an operation of the image forming apparatus of the aforesaid constitution will be described.

When an image forming starting signal is inputted into the image forming apparatus main body 1, the photosensitive body drum 3*a* starts rotating in the direction of the shown arrow, and is uniformly charged by the primary charger 2*a*. Then, the laser beam modulated by an image signal corresponding to a black component of a manuscript image is irradiated on the surface of the photosensitive body drum 3*a* by the exposure unit 117, and the electrostatic latent image is formed. The electrostatic latent image, when a black toner is supplied by the developer 1*a*, is developed (visualized as an image) as a black toner image.

On the other hand, the recording material P stored in the feeding cassette 10 is supplied by the feeding roller 11, after skew is corrected by the pair of registration rollers 12 being stopped temporarily, and supplied to the transferring belt 130 in a manner to adjust the timing to the toner image formed on the photosensitive body drum 3*a*. The recording material P supplied to the transferring belt 130 is transferred with the toner image on the photosensitive body drum 3*a* by the transferring charger 24*a* in a transferring section (a section abutting on the photosensitive body drum 3*a* and the transferring belt 130) of the image forming station Pa.

The same process as the process in the aforesaid image forming station Pa is also carried out in the same manner in the remaining three image forming stations Pb, Pc and Pd, thereby the toner image of each color of magenta, yellow and cyan is transferred in turn on the recording material P. The recording material P completed of transfer of a 4-color toner image is separated from the transferring belt 130 while being removed of an AC bias by the separating charger 32, and transferred to the fixing unit 9. The recording material P, after being heated and pressed at this stage and the toner image being fixed on the surface, is discharged on the delivery tray 63.

The maximum image width in the aforesaid image forming apparatus is about 290 mm on the side of an A4 size paper, and the peripheral speed of the photosensitive body drums 3*a*, 3*b*, 3*c* and 3*d* is 300 mm/sec.

Figure 2:
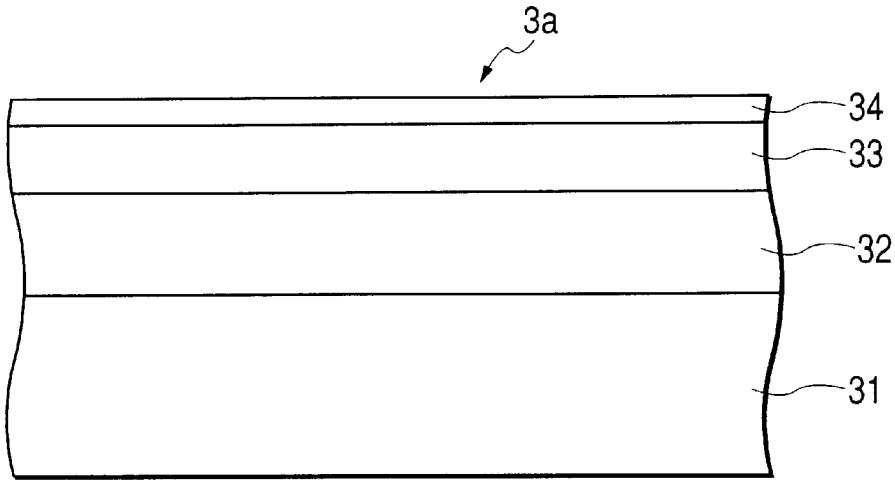
FIG. 2 is a longitudinal section for describing a layer constitution of a photosensitive body.

In FIG. 2, an enlarged longitudinal section of the photosensitive body drum 3*a* is shown. The photosensitive body drum 3*a* comprises a conductive base material 31 and a charge generating layer 32 covered on its surface, a charge transporting layer 33 covered on the surface of the charge generating layer 32, and a mould releasing layer 34 covered on the surface of the charge transporting layer 33. Since the three other photosensitive body drums 3*b*, 3*c* and 3*d* are of similar constitution, description thereof will be omitted.

Figure 3:
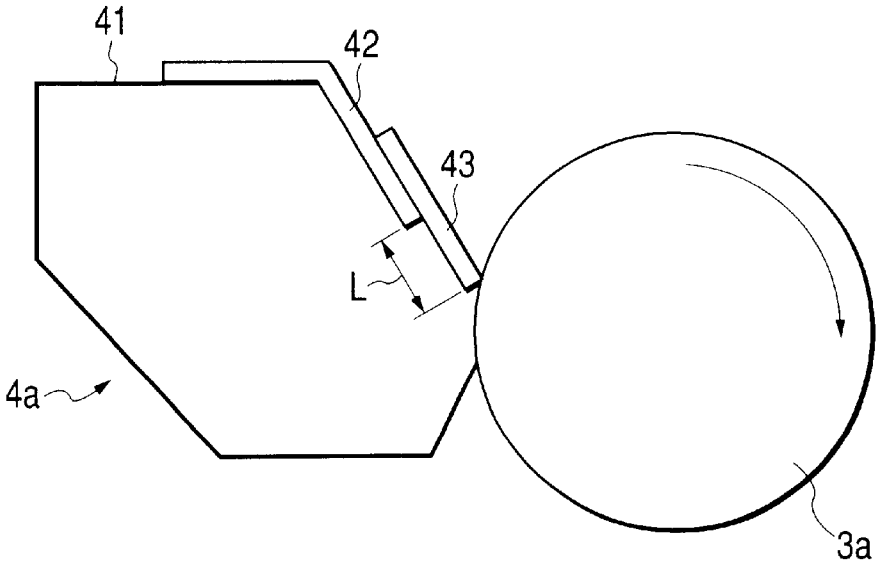
FIG. 3 a longitudinal section showing a constitution of a cleaning unit.

Now referring to FIG. 3, the cleaning unit 4*a* will be described. The cleaning unit 4*a* comprises a cleaning container 41, a back plate 42 fixed to the cleaning container 41, and a cleaning blade 43 held by the back plate 42.

The cleaning blade 43 is an elastic blade of a thickness of 2 mm mainly of urethane with a hardness of 77 (Shore hardness), an impact resilience ratio of 41% (an impact resilience ratio 63% at 40° C.), a 300% modulus 200 kgf/cm$^2$ (200×9.8 N/cm$^2$: both in accordance with Japanese Industrial Standards (JIS)). The cleaning blade 43, with respect to the photosensitive body drum 3*a*, in a state being abutted at an abutting angle of 24° and abutting pressure of 33 gf/cm (33×980 dyne/cm), is held by the back plate 42. The back plate 42 is a plate-like stainless steel member of a thickness of 1 mm. A length of a section protruding from the back plate 42 of the cleaning blade 43, a so-called free length L, is 10 mm. Since the three other cleaning units 4*b*, 4*c* and 4*d* are of similar constitution, description thereof will be omitted.

As the front exposure device 111*a*, a light emitting diode (element GaAlAs) mainly of a peak wavelength of 660 nm is used, a half-amplitude level being ½ of the peak wavelength is about 25 mm, and the light exposure is 20 $\mu$J/cm$^2$. The photosensitive body drum 3*a* rotates at about 50 mm/sec from the front exposure device 111*a* to the primary charger 2*a*.

The fixing unit 9 comprises a fixing roller 51, a pressure roller 52, heat resistant cleaning members 54 and 55 for cleaning these components, roller heaters 56 and 57 installed in the fixing roller 51 and the pressure roller 52, a coating roller 50 for coating mould releasing oil, dimethyl silicone oil, and the like to the fixing roller 51, an oil basin 53 thereof, and a thermistor 58 for detecting the surface temperature of the pressure roller 52 and controlling the fixing temperature. The recording material P transferred with the 4-color toner image, after color mixing and sticking of the toner image to the recording material P by the fixing unit 9, is formed with a copy image of full color.

Incidentally, as a toner for the color used in the present embodiment, a mixture of a polymer toner manufactured by the suspension polymerization method and a resin magnetic carrier manufactured by the polymerization method were used as a two-component developer. Weight (T/D ratio) of the toner to the former weight of the obtained developer was 8%. As the magnetic carrier, one in which the magnetizing amount in the magnetic field of one kilo oersted is 100 emu/cm$^3$, mean grain size of the count is 40 $\mu$m, and specific resistance is $10^{13}$ Ω·cm, was used. And, as a non-magnetic polymer toner, one in which the toner is substantially spherical with a smooth surface and a shape factor SF1 (which will be described later) is 115, SF2 (described later) is 110, weight average grain size is 8 $\mu$m, specific gravity is 1.05 g/cm$^3$, and mean charging amount per unit mass is 25 pc/g, was used.

Now, the shape factors SF1 and SF2 will be described.

Using a scanning type electron microscope FE-SEM (S-800) manufactured by Hitachi, Ltd., 100 toner grains were sampled at random, image information thereof was introduced into an image analyzer (Luzex3) manufactured by Nireco Co., Ltd. and analyzed by means of an interface, and the value obtained by calculation of the following equation was defined as the shape factor SF1 and the shape factor SF2.

$$SF1=\{(MXLNG)^2/(AREA)\}\times(\pi/4)\times 100$$

$$SF2=\{(PERI)^2/(AREA)\}\times(1/4\pi)\times 100$$

Wherein

AREA: Projected area of the toner

MXLNG: Absolute maximum length of the toner

PERI: Peripheral length of the toner

Furthermore, in case the toner is completely spherical, both the shape factor SF1 and the shape factor SF2 take a minimum value of 100. As the numerical value of the shape factor SF1 is larger, the degree of flatness of an ellipse increases, and as the numerical value of the shape factor SF2 is larger, the unevenness of circumference increases.

As the polymer toner used in the present invention, the substantially spherical toner with the shape factor SF1 thereof being in a range of 100 to 140 and the shape factor SF2 being in a range of 100 to 120 is preferable to maintain a high transfer efficiency.

Further, as the grain size of the toner, in view of image quality, a good image can be obtained from a toner with weight average grain size in a range of 6 to 10 $\mu$m, and such toner is preferable.

In the aforesaid image forming apparatus, the aforesaid spherical toner in which the amount of toner on the photosensitive body drum with 30% of a fluororesin dispersed on the mould releasing layer 34 of the photosensitive body drum being equivalent to 0.5 mg/cm$^2$ is developed, in a system in which the recording material P is not supplied, an image forming equivalent to 100 sheets of A4 size paper is performed, when the spherical toner on the photosensitive body drum is cleaned with the aforesaid cleaning blade, linear pressure of the cleaning drum to the photosensitive body drum is measured, and the edge section of the cleaning blade is observed, the apparatus for image forming is shown in FIG. 1. Further, unit of the linear pressure of the cleaning blade (blade) in FIG. 1 is N (Newton)/cm.

As shown in FIG. 5, toner passing occurred when the linear pressure of the blade is $200\times10^{-3}$ (N/cm), no toner passing and no chattering (abnormal vibration) occurred when the blade linear pressure is in a range of $250\times10^{-3}$ to $550\times10^{-3}$ ($250\times10^{-3}$, $300\times10^{-3}$, $400\times10^{-3}$, $500\times10^{-3}$ and $550\times10^{-3}$) , and chattering occurred when the blade linear pressure is $600\times10^{-3}$.

From the result of the above, in the aforesaid constitution, to carry out a good cleaning during an initial stage to the start of using the image forming apparatus, it was judged that the linear pressure A of the cleaning blade to the photosensitive body drum, in case the addition ratio of the fluororesin of the mould releasing layer of the photosensitive body drum is 30%, as $200\times10^{-3}<A<600\times10^{-3}$ (N/cm). Further, since the dynamic friction coefficient $\mu$ between the photosensitive body drum surface and the cleaning blade does not depend on the linear pressure of the cleaning blade to the photosensitive body drum, in the following embodiments, description will be given assuming that the linear pressure A is the aforesaid $400\times10^{-3}$ (N/cm) which is in the aforesaid range of $200\times10^{-3}<A<600\times10^{-3}$ (N/cm).

Here, a method for measuring the dynamic friction coefficient will be described.

When the photosensitive body which is the image bearing body is a sheet-like, flat-plate like or endless (without end) belt-like, the dynamic friction coefficient $\mu$ between the cleaning blade and the photosensitive body surface is usually measured by a surface property testing equipment (model HEIDON-14) manufactured by HEIDON Co., Ltd. By pressing the cleaning blade against the photosensitive body under a fixed load (gf), the force (gf) applied when the cleaning blade is moved parallel to the photosensitive body surface under this condition is measured. The dynamic friction coefficient $\mu$ is obtained by the [force (gf) applied to the photosensitive body]/[load (gf) applied to the blade] when the blade is started to move.

However, the photosensitive body to be assembled in the electrophtographic image forming apparatus is mainly a drum-like photosensitive body drum, the dynamic friction coefficient $\mu$ in this case, after measuring the rotating torque T1 (kgf·cm) of the photosensitive body drum itself and the rotating torque T2 (kgf·cm) in a system with the residual toner being interposed after a process of transferring to the photosensitive body drum welded with pressure by the cleaning blade under a load F (kgf), can be obtained by calculating the following equation:

$$\mu=(T2-T1)/(F\cdot\gamma)$$

wherein $\gamma$ is a radius (cm) of the photosensitive body drum.

(First Embodiment)

In the aforesaid image forming apparatus, using as the photosensitive body drum with a surface roughness Rz thereof being 1.5 and 30% of the fluororesin (TEFLON™, for example) being dispersed to the mould releasing layer of the outermost layer, an actual copying test was carried out to copy 20 thousand sheets of 10% image covering ratio by continuously copying 100 sheets in an environment of normal temperature and humidity, an image obtained from the 20 thousandth sheet was visually evaluated, and the result thereof is shown in FIG. 6. When the dynamic friction coefficient $\mu$ was 0.48, cleaning performance was good.

The surface roughness Rz shown here indicates the 10 point mean surface roughness defined by JIS B0601.

(Second Embodiment)

In the same constitution as the aforesaid embodiment 1, using the photosensitive body drum with a surface roughness Rz thereof being 1.5 and the ratio of the fluororesin caused to be dispersed on the mould releasing layer being 20%, an actual copying test was carried out to copy 20 thousand sheets of 10% image covering ratio by continuously copying 100 sheets in an environment of normal temperature and humidity, an image obtained from the 20 thousandth sheet was visually evaluated, and the result thereof is also shown in FIG. 6. The dynamic friction coefficient $\mu$ between the photosensitive body surface and the cleaning blade increased due to a decrease of the fluororesin and turned out to be 0.63 which was in the allowable range, and turning up and chattering of the cleaning blade were not observed.

(Third Embodiment)

In the same constitution as the aforesaid embodiment 1, using the photosensitive body drum with a surface roughness thereof being 1.5 and the ratio of a fluororesin to be dispersed on the mould releasing layer being 10%, an actual copying test was carried out to copy 20 thousand sheets of 10% images covering ratio by continuously copying 100 sheets in an environment of normal temperature and humidity, an image obtained from the 20 thousandth sheet was visually evaluated, and the result thereof is also shown in FIG. 6. An increase in the dynamic friction coefficient $\mu$ between the photosensitive body surface layer and the cleaning blade is reduced by the roughness of the surface caused by the initial grinding of the mould releasing layer, turned out to be 1.28, and thus good cleaning performance was secured.

COMPARISON EXAMPLE 1

In a comparison with embodiment 3, using the photosensitive body drum having the surface roughness initially ground to 3.0 and the mould releasing layer of 0% fluororesin, an actual copying test was carried out to copy 20 thousand sheets of 10% image covering ratio by continuously copying 100 sheets in an environment of normal temperature and humidity, an image obtained from the 20 thousandth sheet was visually evaluated, and the result thereof is also shown in FIG. 6. The dynamic friction coefficient $\mu$ increased to as high as 3.11, and chipping of the cleaning blade occurred.

(Fourth Embodiment)

Using the photosensitive body drum having the initial grinding of the photosensitive body surface of Rz=0.2, and the mould releasing layer of 30% fluororesin, an actual copying test was carried out to copy 20 thousand sheets of 10% image covering ratio by continuously copying 100 sheets in an environment of normal temperature and humidity, an image obtained from the 20 thousandth sheet was visually evaluated, and the result thereof is also shown in FIG. 6. The dynamic friction coefficient $\mu$ was reduced to 2.53 due to the effect of the fluororesin, and the image obtained was satisfactory.

COMPARISON EXAMPLE 2

In a comparison with embodiment 4, using the photosensitive body having the initial grinding of Rz=0.2 and the mould releasing layer of 20% fluororesin, an actual copying test was carried out to copy 20 thousand sheets of 10% image covering ratio by continuously copying 100 sheets in an environment of normal temperature and humidity, an image obtained from the 20 thousandth sheet was visually evaluated, and the result thereof is also shown in FIG. 6. Since the dynamic friction coefficient $\mu$ increased to as high as 2.88, chipping of the cleaning blade occurred.

COMPARISON EXAMPLE 3

In a comparison with embodiment 3, using the photosensitive body drum having the initial grinding of Rz=3.0 and 30% of the fluororesin on the mould releasing layer, an actual copying test was carried out to copy 20 thousand sheets of 10% image covering ratio by continuously copying 100 sheets in an environment of normal temperature and humidity, an image obtained from the 20 thousandth sheet was visually evaluated, and the result thereof is also shown in FIG. 6. The dynamic friction coefficient $\mu$ turned out to be 0.34, since the coefficient of friction was too low, the force to scrape off the residual toner of the cleaning blade was weakened, and passing of the residual toner from the blade was observed.

(Fifth Embodiment)

In a comparison with embodiment 3, using the photosensitive body drum having the initial grinding of Rz=4.0 and 10% of the fluororesin on the mould releasing layer, an actual copying test was carried out to copy 20 thousand sheets of 10% image covering ratio by continuously copying 100 sheets in an environment of normal temperature and humidity, an image obtained from the 20 thousandth sheet was visually evaluated, and the result thereof is also shown in FIG. 6. Due to the effect of the surface roughness, the dynamic friction coefficient $\mu$ was reduced to 1.18, and the cleaning performance was satisfactory.

COMPARISON EXAMPLE 4

In a comparison with embodiment 3, using the photosensitive body drum having the initial grinding of Rz=5.0 and 10%.of the fluororesin on the mould releasing layer, an actual copying test was carried out to copy 20 thousand sheets of 10% image covering ratio by continuously copying 100 sheets in an environment of normal temperature and humidity, an image obtained from the 20 thousandth sheet was visually evaluated, and the result thereof is also shown in FIG. 6. Though the dynamic friction coefficient $\mu$ is within the allowable cleaning range, since the surface roughness Rz was too high, passing of the residual toner from the blade edge section occurred.

(Sixth Embodiment)

Using the photosensitive body drum having the initial grinding of Rz=0.1 and 40% of the fluororesin on the mould releasing layer, an actual copying test was carried out to copy 20 thousand sheets of 10% image covering ratio by continuously copying 100 sheets in an environment of normal temperature and humidity, an image obtained from the 20 thousandth sheet was visually evaluated, and the result thereof is also shown in FIG. 6. Also, in a system in which the fairly excessive fluororesin as high as 40% exists, when the surface roughness is specified to Rz=0.1, cleaning was carried out satisfactory.

COMPARISON EXAMPLE 5

In a comparison with embodiment 6, using the photosensitive body drum having the initial grinding of Rz=0.1 and 50% of a fluororesin on the mould releasing layer, an actual copying test was carried out to copy 20 thousand sheets of 10% image covering ratio by continuously copying 100 sheets in an environment of normal temperature and humidity, an image obtained from the 20 thousandth sheet was visually evaluated, and the result thereof is also shown in FIG. 6. Since the excessive fluororesin existed, the dynamic friction coefficient $\mu$ was reduced excessively to 0.38, and passing of the residual toner from the blade edge section occurred.

Figure 4:
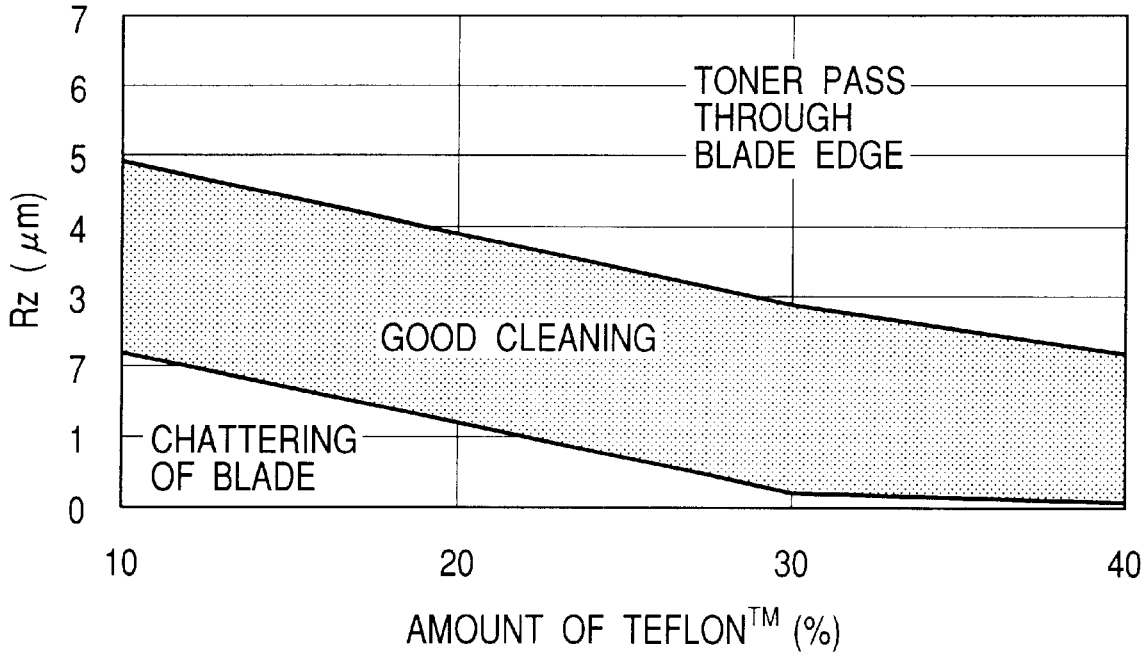
FIG. 4 is a view showing the relation between the amount of TEFLON™ and a surface roughness Rz with respect to cleaning performance.

The results described above are shown in FIG. 4. FIG. 4, in the image forming apparatus, shows the relation between the amount of TEFLON (ratio of the fluororesin contained in the mould releasing layer of the photosensitive body drum) enabling good cleaning and the surface roughness Rz due to the initial grinding.

An area of "good cleaning" in FIG. 4 corresponds to a range where the dynamic friction coefficient $\mu$ between the photosensitive body drum and the cleaning blade is in a range of 0.5 to 2.5.

The present invention can provide a dynamic friction coefficient $\mu$ in a range of 0.5 to 2.5 enabling good cleaning by making an optimum combination of an amount of TEFLON™ in a range of 10% to 40% and a Rz of the photosensitive body surface of less than 5 $\mu$m.

As a result, as compared to a 1.0 range of the dynamic friction coefficient of good cleaning disclosed in Japanese Patent Application Laid-Open No. 4-335387 and Japanese Patent Application Laid-Open No. 11-218953, since it becomes possible to obtain 2.0 which is two times the range according to the present invention, it is possible to fit the dynamic friction range of coefficient into this range, and obtain stable cleaning performance.

Further, in a system in which the dynamic friction coefficient $\mu$ exceeds 2.5, it is essential to apply an extremely high blade pressure to the image bearing body (photosensitive body drum) in order to satisfactorily clean the spherical toner with a high roundness as described in the present invention, and chipping and chattering of the cleaning blade occur in this case. Further, in a system in which the dynamic friction coefficient $\mu$ is below 0.5, adhesion between the image bearing body (photosensitive body drum) and the edge section of the cleaning blade is lost contrary to the aforesaid case, the aforesaid spherical toner with high lubricating performance easily passes through the blade edge section, causing a defective image.

That is, according to the present invention, it is possible to satisfactorily clean the toner with a high roundness having been regarded in the past as difficult to clean, without adding a cleaning assistant (lubricant) to the edge section of the blade. Further, in order to satisfactorily clean the spherical toner with a high roundness, it is necessary to apply a higher blade load to the photosensitive body surface than a unshaped toner, and in this case, chipping of the cleaning blade, permanent set and shear stress tend to increase, but by specifying the dynamic friction coefficient $\mu$ as described above, it is possible to reduce chipping, permanent set and shear stress, and it is further possible to prevent fusion of the toner due to an increase in the calorific value of the cleaning blade.

Still further, as a result, it is possible to cause the reliability of the image forming apparatus to be improved greatly, and the productivity to be increased.

In the description of the above, as the image forming apparatus, a type of the image forming apparatus was described in which the toner image formed on the photosensitive body drums 3*a*, 3*b*, 3*c* and 3*d* are transferred directly onto the recording material P borne on the transferring belt 130 as the recording material bearing body. However, the present invention is not limited to the image forming apparatus such as this but can also be applied to an image forming apparatus using one image bearing body, for example. Furthermore, the present invention can also be applied to an image forming apparatus of a type using an intermediate transferring body. That is, the present invention can also be applied to an image forming apparatus of a type in which the toner image formed on the photosensitive body drum is transferred primarily onto the intermediate transferring body (intermediate transferring drum and intermediate transferring belt, for example), and then, the toner image is transferred secondarily onto the recording material P from the upper part of the intermediate transferring body.

In the aforesaid embodiment, an example using a non-magnetic polymer toner is shown, but in the present invention, if the toner is a substantially spherical toner, the present invention will not be limited thereto.

As described in the above, according to the present invention, it is possible to prevent damage of the cleaning blade and defective cleaning, and obtain stable cleaning performance when cleaning the substantially spherical toner.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An image forming apparatus comprising:

a first image bearing body for bearing an image formed with a substantially spherical toner;

a transferring means for transferring a toner image on said first image bearing body onto a second image bearing body; and a cleaning member for sweeping away the toner remaining on said first image bearing body after a transferring operation by said transferring means, the cleaning member abutting on said first image bearing body, wherein it is simultaneously satisfied that said first image bearing body contains a fluororesin on its surface, wherein a content ratio F (% by weight) of said fluororesin is in a range of $10 \leqq F \leqq 50$, wherein a surface roughness Rz ($\mu$m) of said first image bearing body is Rz<5.0, and wherein a dynamic friction coefficient $\mu$ between said first image bearing body and said cleaning member is in a range of $0.5 \leqq \mu \leqq 2.5$.

2. An image forming apparatus according to claim 1, wherein said first image bearing body comprises a plurality of layers and contains a fluororesin on the surface of each layer.

3. An image forming apparatus according to claim 1, wherein the surface of said first image bearing body has a surface roughness of Rz<5.0.

4. An image forming apparatus according to claim 1, wherein a weight average grain size R ($\mu$m) of said toner is in a range of $6 \leqq R \leqq 10$ $\mu$m.

5. An image forming apparatus according to claim 4, wherein a shape factor SF1 of said toner is in a range of $100 \leqq SF1 \leqq 140$, and a shape factor SF2 of said toner is in a range of $100 \leqq SF2 \leqq 120$.

6. An image forming apparatus according to claim 1, wherein a linear pressure A (N/cm) of said cleaning member abutting on said first image bearing body is in a range of $200 \times 10^{-3} < A < 600 \times 10^{-3}$.

7. An image forming apparatus according to claim 1, wherein said cleaning member comprises a blade member having elasticity.

8. An image forming apparatus according to claim 7, wherein said blade member abuts in a direction counter to a moving direction of said first image bearing body.

9. An image forming apparatus according to claim 8, wherein said blade member is made of a urethane rubber.

10. An image forming apparatus according to any one of claims 1, 4 and 5, wherein said toner is a nonmagnetic toner.

11. An image forming apparatus according to claim 10, wherein said toner is manufactured by a polymerization method.

12. An image forming apparatus according to claim 1, comprising a conveying body for conveying said second image bearing body.

wherein a plurality of first image bearing bodies are provided in a conveying direction of said conveying body, and wherein toner images carried by said plurality of first image bearing bodies are formed to be overlaid in turn on the second image bearing body conveyed by said conveying body.

13. An image forming apparatus according to claim 12, wherein the toner images formed on said plurality of first image bearing bodies have different colors, respectively.

14. An image forming apparatus according to claim 1, wherein said dynamic friction coefficient $\mu$ is obtained from the following equation:

$$\mu = (T2 - T1)/(F \cdot \gamma),$$

wherein $\gamma$ (cm) is a radius of a rotating body which is said first image bearing body, T1 (kgf·cm) is a rotating torque when said cleaning member does not abut on said first image bearing body, T2 (kgf·cm) is a rotating torque when said cleaning member abuts thereon, and F (kgf) is an abutting load of said cleaning member to said first image bearing body.

* * * * *

UNITED STATES PATENT AND TRADEMARK OFFICE

CERTIFICATE OF CORRECTION

PATENT NO. : 6,560,427 B2
DATED : May 6, 2003
INVENTOR(S) : Norihiko Kubo

It is certified that error appears in the above-identified patent and that said Letters Patent is hereby corrected as shown below:

Column 1,
Line 54, “essential” should read -- essential for --.

Column 3,
Line 36, “itself” should read -- themselves --;
Line 41, “lates” should read -- late --; and
Line 52, “descried” should read -- described --

Column 5,
Line 22, “stations” should read -- station --; and
“is” should read -- are --.

Column 7,
Line 59, “SF2.” should read -- SF2: --; and
Line 63, “Wherein” should read -- wherein --.

Column 9,
Line 48, “images” should read -- image --.

Column 10,
Line 62, “10%.of” should read -- 10% of --.

Column 14,
Line 4, “claim 1,” should read -- claim 1, further --.

UNITED STATES PATENT AND TRADEMARK OFFICE

CERTIFICATE OF CORRECTION

PATENT NO. : 6,560,427 B2
DATED : May 6, 2003
INVENTOR(S) : Norihiko Kubo

It is certified that error appears in the above-identified patent and that said Letters Patent is hereby corrected as shown below:

Column 17,
Line 6, “body.” should read -- body, --.

Signed and Sealed this

Seventh Day of October, 2003

JAMES E. ROGAN
*Director of the United States Patent and Trademark Office*